US009807505B2

(12) United States Patent
Barzen

(10) Patent No.: US 9,807,505 B2
(45) Date of Patent: Oct. 31, 2017

(54) SYSTEM AND METHOD FOR A PUMPING SPEAKER

(71) Applicant: Infineon Technologies AG, Neubiberg (DE)

(72) Inventor: Stefan Barzen, Munich (DE)

(73) Assignee: Infineon Technologies AG, Neubiberg (DE)

( * ) Notice: Subject to any disclaimer, the term of this patent is extended or adjusted under 35 U.S.C. 154(b) by 1 day.

(21) Appl. No.: 14/818,836

(22) Filed: Aug. 5, 2015

(65) Prior Publication Data

US 2017/0041708 A1 Feb. 9, 2017

(51) Int. Cl.

| | |
|---|---|
| ***H04R 29/00*** | (2006.01) |
| ***H04R 3/06*** | (2006.01) |
| ***H04R 19/00*** | (2006.01) |

(52) U.S. Cl.

CPC ..... *H04R 3/06* (2013.01); *H04R 19/005* (2013.01); *H04R 29/001* (2013.01); *H04R 2201/003* (2013.01)

(58) Field of Classification Search

CPC H04R 2499/11; H04R 2460/13; H04R 11/02; H04R 17/00; H04R 19/005; H04R 19/04; H04R 25/606; H04R 5/02; H04R 7/02; H04R 19/02; H04R 1/00; H04M 1/0264; H04M 1/605; H04M 1/6058; H04M 2250/12; G10K 11/18; G10K 15/046; H04L 65/403; H04L 67/02; H04L 67/10

USPC ..... 381/56–58, 77, 79, 152, 160, 182, 186, 381/386, 387, 189, 190, 191, 431

See application file for complete search history.

(56) References Cited

U.S. PATENT DOCUMENTS

| | | | | |
|---|---|---|---|---|
| 8,199,931 B1 * | 6/2012 | Norris | H04R 17/00 181/142 |
| 2007/0183605 A1 * | 8/2007 | Yoshino | H04R 3/12 381/59 |
| 2016/0286319 A1 * | 9/2016 | Kupershmidt | H04R 19/02 |

* cited by examiner

*Primary Examiner* — Lun-See Lao

(74) *Attorney, Agent, or Firm* — Slater Matsil, LLP

(57) ABSTRACT

According to an embodiment, a method of operating a speaker with an acoustic pump includes generating a carrier signal having a first frequency by exciting the acoustic pump at the first frequency and generating an acoustic signal having a second frequency by adjusting the carrier signal. In such embodiments, the first frequency is outside an audible frequency range and the second frequency is inside the audible frequency range. Adjusting the carrier signal includes performing adjustments to the carrier signal at the second frequency. Other embodiments include corresponding systems and apparatus, each configured to perform corresponding embodiment methods.

30 Claims, 14 Drawing Sheets

SYSTEM AND METHOD FOR A PUMPING SPEAKER

TECHNICAL FIELD

The present invention relates generally to speakers, and, in particular embodiments, to a system and method for a pumping speaker.

BACKGROUND

Transducers convert signals from one domain to another and are often used as sensors. For example, acoustic transducers convert between acoustic signals and electrical signals. A microphone is one type of acoustic transducer that converts sound waves, i.e., acoustic signals, into electrical signals, and a speaker is one type of acoustic transducer that converts electrical signals into sound waves.

Microelectromechanical system (MEMS) based sensors include a family of transducers produced using micromachining techniques. Some MEMS, such as a MEMS microphone, gather information from the environment by measuring the change of physical state in the transducer and transferring the signal to be processed by the electronics which are connected to the MEMS sensor. Some MEMS, such as a MEMS microspeaker, convert electrical signals into a change in the physical state in the transducer. MEMS devices may be manufactured using micromachining fabrication techniques similar to those used for integrated circuits.

MEMS devices may be designed to function as oscillators, resonators, accelerometers, gyroscopes, pressure sensors, microphones, micro-mirrors, microspeakers, etc. Many MEMS devices use capacitive sensing or actuation techniques for transducing the physical phenomenon into electrical signals and vice versa. In such applications, the capacitance change in the transducer is converted to a voltage signal using interface circuits or a voltage signal is applied to the capacitive structure in the transducer in order to generate a force between elements of the capacitive structure.

For example, a capacitive MEMS microphone includes a backplate electrode and a membrane arranged in parallel with the backplate electrode. The backplate electrode and the membrane form a parallel plate capacitor. The backplate electrode and the membrane are supported by a support structure arranged on a substrate.

The capacitive MEMS microphone is able to transduce sound pressure waves, for example speech, at the membrane arranged in parallel with the backplate electrode. The backplate electrode is perforated such that sound pressure waves pass through the backplate while causing the membrane to vibrate due to a pressure difference formed across the membrane. Hence, the air gap between the membrane and the backplate electrode varies with vibrations of the membrane. The variation of the membrane in relation to the backplate electrode causes variation in the capacitance between the membrane and the backplate electrode. This variation in the capacitance is transformed into an output signal responsive to the movement of the membrane and forms a transduced signal.

Using a similar structure, a voltage signal may be applied between the membrane and the backplate in order to cause the membrane to vibrate and generate sound pressure waves. Thus, a capacitive plate MEMS structure may operate as a microspeaker.

SUMMARY

According to an embodiment, a method of operating a speaker with an acoustic pump includes generating a carrier signal having a first frequency by exciting the acoustic pump at the first frequency and generating an acoustic signal having a second frequency by adjusting the carrier signal. In such embodiments, the first frequency is outside an audible frequency range and the second frequency is inside the audible frequency range. Adjusting the carrier signal includes performing adjustments to the carrier signal at the second frequency. Other embodiments include corresponding systems and apparatus, each configured to perform corresponding embodiment methods.

BRIEF DESCRIPTION OF THE DRAWINGS

For a more complete understanding of the present invention, and the advantages thereof, reference is now made to the following descriptions taken in conjunction with the accompanying drawings, in which.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

Figure 1:
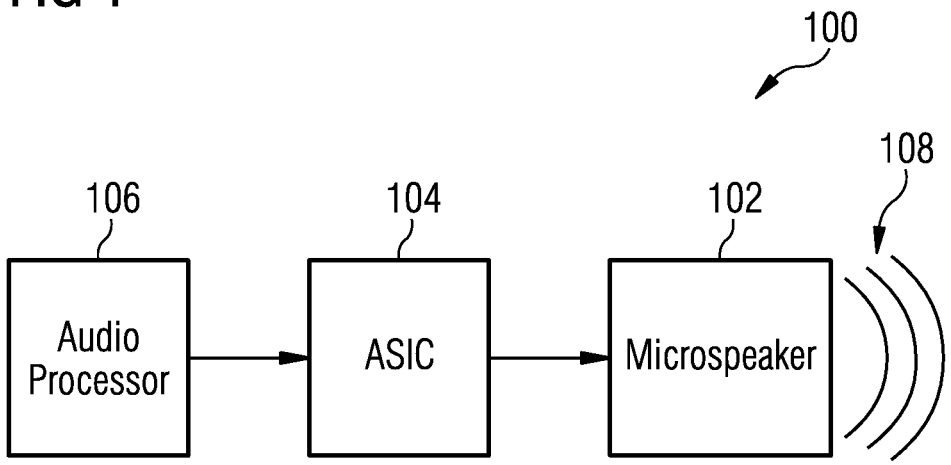
FIG. 1 illustrates a system block diagram of an embodiment pumping speaker system.

The making and using of various embodiments are discussed in detail below. It should be appreciated, however, that the various embodiments described herein are applicable in a wide variety of specific contexts. The specific embodiments discussed are merely illustrative of specific ways to make and use various embodiments, and should not be construed in a limited scope.

Description is made with respect to various embodiments in a specific context, namely acoustic transducers, and more particularly, MEMS microspeakers. Some of the various embodiments described herein include MEMS microspeakers, acoustic transducer systems, pumping speakers, and pumping MEMS microspeakers. In other embodiments, aspects may also be applied to other applications involving any type of transducer converting a physical signal to another domain according to any fashion as known in the art.

Speakers are transducers that transduce electrical signals into acoustic signals. The acoustic signal is produced by the speaker structure generating pressure oscillations at a frequency. For example, the audible range of humans is about 20 Hz to 22 kHz, with some humans able to hear less than this range and some humans able to hear beyond this range. Thus, a speaker operating in order to produce audible acoustic signals transduces electrical signals into pressure oscillations with frequencies between 20 Hz and 22 kHz. A constant frequency signal is conveyed as a simple tone, similar to a note on a piano. Speech and other typical sounds such as, e.g., music, are composed of numerous acoustic signals with numerous frequencies.

Microspeakers operate according to the same principles as speakers, but are produced using micromachining or microfabrication techniques. Thus, audible microspeakers include small structures that are excited by electrical signals in order to generate pressure oscillations in the audible frequency range.

According to various embodiments, a speaker, or microspeaker, is configured to generate audible acoustic signals by oscillating at frequencies above the audible frequency range. In such embodiments, the speaker is configured to generate pressure oscillations at a frequency above the audible range and modify the direction and amplitude of the pressure oscillations according to a lower frequency in the audible frequency range. In additional embodiments, the speaker may be configured to generate pressure oscillations at a frequency above the audible range and modify the direction and amplitude of the pressure oscillations according to a lower frequency still outside the audible frequency range in order to operate as an ultrasound transducer.

In various embodiments, the speaker is referred to as a pumping speaker. The frequency of the pumping speaker may maintain operation outside the audible frequency range while the pumping action alters the amplitude and direction of the oscillations according to other frequencies inside the audible frequency range. In such embodiments, the pumping speaker may include a pump structure, or a micropump, which is configured to pump at a frequency above the audible frequency limit, vary the amplitude of pumping, and control the direction of pumping. Various embodiments are further described herein below.

FIG. 1 illustrates a system block diagram of an embodiment pumping speaker system 100 including microspeaker 102, application specific integrated circuit (ASIC) 104, and audio processor 106. According to various embodiments, microspeaker 102 generates acoustic signal 108, which includes pressure oscillations at a frequency above the audible limit, e.g., 22 kHz, with amplitude and direction adjustments of the pressure oscillations. The amplitude and direction of the pressure oscillations are adjusted at frequencies in the audible range. Thus, microspeaker 102 generates acoustic signal 108 including an audible acoustic signal formed from an inaudible acoustic signal.

In various embodiments, microspeaker 102 includes an acoustic pump or micropump. Various example embodiment micropumps are described further herein below. Microspeaker 102 is driven by drive signals provided from ASIC 104. ASIC 104 may generate analog drive signals based on a digital input control signal. In some embodiments, ASIC 104 and microspeaker 102 are attached to a same circuit board. In other embodiments, ASIC 104 and microspeaker 102 are formed on a same semiconductor die. ASIC 104 may include biasing and supply circuits, an analog drive circuit, and a digital to analog converter (DAC). In further embodiments, microspeaker 102 may include a microphone, for example, and ASIC 104 may also include readout electronics such as an amplifier or analog to digital converter (ADC).

In some embodiments, the DAC in ASIC 104 receives a digital control signal at an input supplied by audio processor 106. The digital control signal is a digital representation of the acoustic signal that microspeaker 102 produces. In various embodiments, audio processor 106 may be a dedicated audio processor, a general system processor, such as a central processing unit (CPU), a microprocessor, or a field programmable gate array (FPGA). In alternative embodiments, audio processor 106 may be formed of discrete logic blocks or other components. In various embodiments, audio processor 106 generates the digital representation of acoustic signal 108 and provides the digital representation of acoustic signal 108. In other embodiments, audio processor 106 provides the digital representation of only the audible portion of acoustic signal 108 and ASIC 104 generates acoustic signal 108 with the higher inaudible frequency oscillations and the audible frequency oscillations based on amplitude and direction adjustments.

In other embodiments, microspeaker 102 may be implemented as any type of speaker fabricated using techniques known to those of skill in the art.

According to various additional embodiments, microspeaker 102 may also generate acoustic signal 108, which includes pressure oscillations at a frequency above the audible limit, e.g., 22 kHz, with amplitude and direction adjustments of the pressure oscillations that are adjusted at frequencies that are also above the audible range. For example, microspeaker 102 may operate as an ultrasound transducer for ultrasound imaging or for ultrasound near field detection. In such embodiments, microspeaker 102 operates with a higher frequency as a carried signal that has amplitude and direction adjusted according to a lower frequency of the generated target signal, such as an ultrasound signal for example.

Figure 2A:
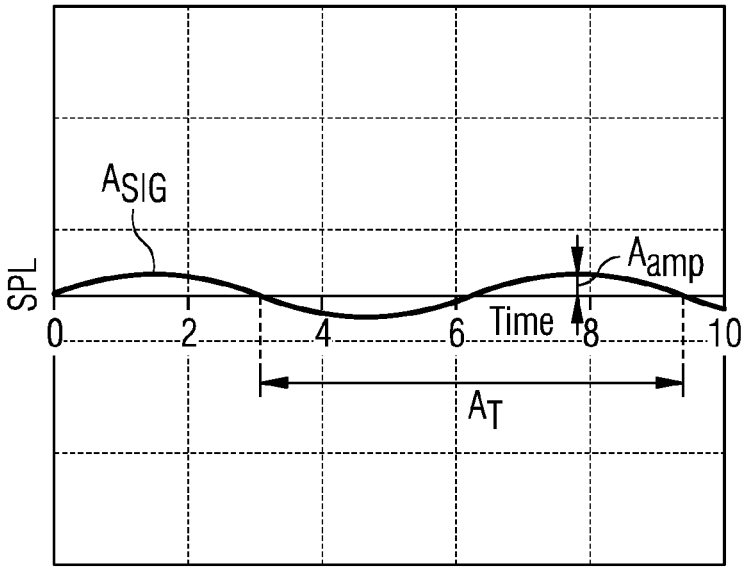
FIGS. 2*a* and 2*b* illustrate waveform diagrams of illustrative acoustic signals.
Figure 2B:
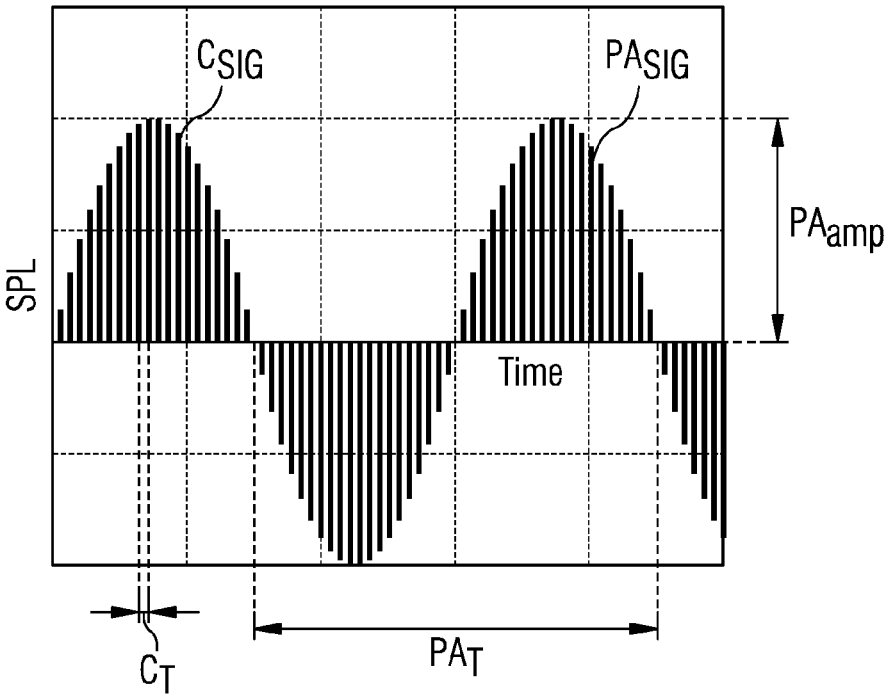

FIGS. 2*a* and 2*b* illustrate waveform diagrams of illustrative acoustic signals. FIG. 2*a* shows acoustic signal $A_{SIG}$ that may be produced by a speaker, for example. Acoustic signal $A_{SIG}$ has amplitude $A_{amp}$ and frequency $A_{freq}$, i.e., period $A_T=1\div A_{freq}$. Acoustic signal $A_{SIG}$ may illustrate a sound wave produced by a speaker. During operation, the sound wave has frequency $A_{freq}$ that is within the audible frequency range for a human, e.g., between about 20 Hz and 22 kHz. FIG. 2*a* illustrates amplitude $A_{amp}$ for acoustic signal $A_{SIG}$ at an unspecified level. For a MEMS microspeaker, generating a large sound pressure level (SPL) may present challenges due to the small size of the membrane, especially at low frequency. For example, a MEMS microspeaker may include a decrease of 40 dB in SPL per decade as frequency decreases through the audible frequency range. Thus, it may be challenging to generate higher SPLs at frequencies below, for example, 1-10 kHz without increasing the size of the pumping structure, for example.

FIG. 2*b* shows pumping acoustic signal $PA_{SIG}$ that may be produced by an embodiment pumping speaker or microspeaker, such as a MEMS microspeaker. According to various embodiments, pumping acoustic signal $PA_{SIG}$ has amplitude $PA_{amp}$ and frequency $PA_{freq}$, i.e., period $PA_T=1\div PA_{freq}$, and is formed of carrier signal $C_{SIG}$, which has variable amplitude $C_{amp}$ and frequency $C_{freq}$, i.e., period $C_T=1\div C_{freq}$. As shown, frequency $C_{freq}$ is much higher than frequency $PA_{freq}$. Specifically, frequency $C_{freq}$ is above the audible frequency range of a human, i.e., above 22 kHz, and frequency $PA_{freq}$ is within the audible frequency range of a human, i.e., between about 20 Hz and 22 kHz. In such embodiments, amplitude $C_{amp}$ is adjusted in order to form the rising and falling wave form of pumping acoustic signal $PA_{SIG}$. Further, the direction of amplitude $C_{amp}$ is also adjusted to allow for pumping in specific directions in order to form the rising and falling wave form of pumping acoustic signal $PA_{SIG}$. The variation of amplitude $C_{amp}$ and direction of carrier signal $C_{SIG}$ is performed at a specific frequency in order to form pumping acoustic signal $PA_{SIG}$ with frequency $PA_{freq}$.

In particular embodiments, amplitude $PA_{amp}$ of acoustic signal $PA_{SIG}$ may be larger than a non-pumping speaker that oscillates at an audible frequency. In specific embodiments, the oscillation of the pumping speaker remains at a higher frequency such that the SPL of pumping acoustic signal $PA_{SIG}$ does not decrease much or at all when frequency $PA_{freq}$ is below about 1-10 kHz and above about 10 Hz, for example.

In various embodiments, frequency $C_{freq}$ may be held constant as amplitude $C_{amp}$ and direction of carrier signal $C_{SIG}$ are varied. In specific embodiments, frequency $C_{freq}$ may be matched to the resonant frequency of the speaker or microspeaker in order to produce greater oscillations of the membrane or pumping structure. In other embodiments, frequency $C_{freq}$ may be variable. In particular examples, frequency $C_{freq}$ is between 50 kHz and 10 MHz. In more specific embodiments, frequency $C_{freq}$ is between 100 kHz and 300 kHz. In such various embodiments, frequency $PA_{freq}$ is below 25 kHz. Specifically, frequency $PA_{freq}$ is in the audible frequency range of humans, i.e., between 20 Hz and 22 kHz, where this range may be expanded for some humans and narrowed for others. In alternative embodiments, frequency $PA_{freq}$ may be above 25 kHz. In such embodiments, pumping acoustic signal $PA_{SIG}$ may be, instead of an acoustic signal, an ultrasound signal used in an ultrasound transducer for ultrasound imaging or near field detection.

According to various embodiments, speakers or microspeakers, such as MEMS microspeakers, are operated as described in reference to FIG. 2*b* by using a carrier signal above the audible frequency range to form a pumping acoustic signal within the audible frequency range. Various embodiment speakers are described herein below in order to illustrate some of the specific applications including capacitive plate structures and other pumping structures.

Referring back to FIG. 1 in view of FIGS. 2*a* and 2*b*, ASIC 104 in pumping speaker system 100 is configured to determine the resonant frequency of microspeaker 102 in some embodiments. In such embodiments, ASIC 104 may excite microspeaker 102 at a plurality of frequencies and measure the response for each frequency. Based on the measured response, ASIC 104 determines the resonant frequency of microspeaker 102. In such embodiments, ASIC 104 may set frequency $C_{freq}$ for carrier signal $C_{SIG}$ to the determined resonant frequency. In other alternative embodiments, ASIC 104 may control elements of microspeaker 102 in order to adjust the resonant frequency to match frequency $C_{freq}$ for carrier signal $C_{SIG}$. In one embodiment, controlling the elements includes adjusting mechanical components of microspeaker 102. In an alternative embodiment, controlling the elements includes adjusting active or passive electrical components of microspeaker 102.

Figure 3A:
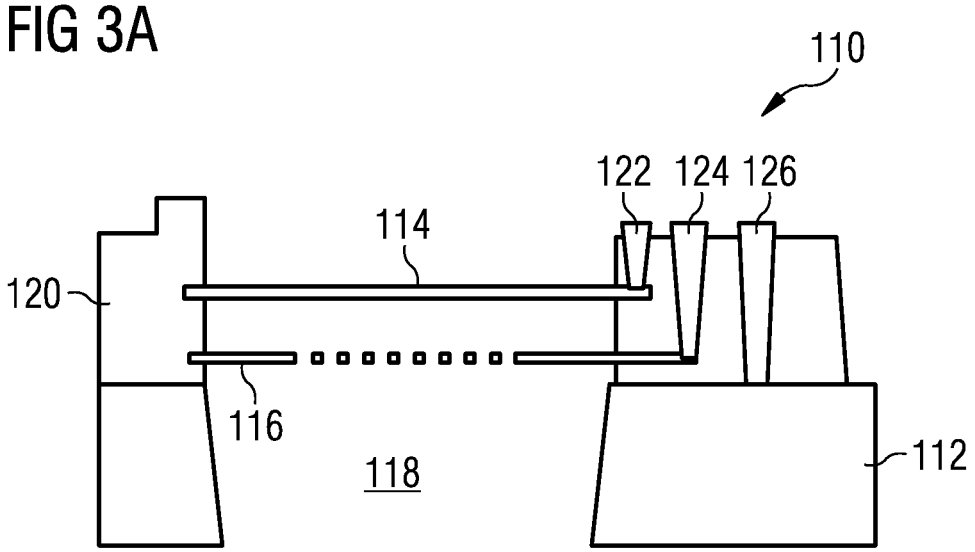
FIGS. 3*a* and 3*b* illustrate cross-sectional views of embodiment pumping speakers.
Figure 3B:
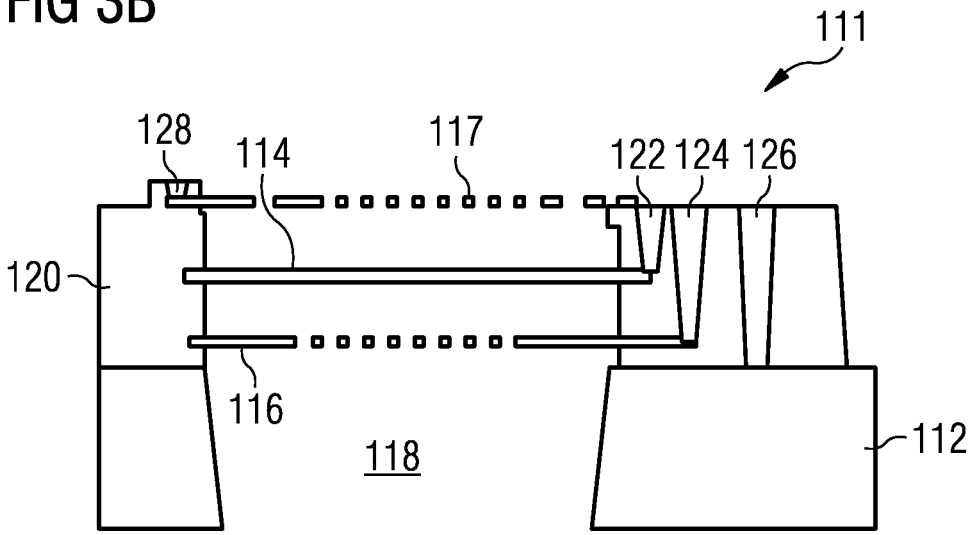

FIGS. 3*a* and 3*b* illustrate cross-sectional views of embodiment pumping speakers 110 and 111. FIG. 3*a* shows single backplate pumping speaker 110 including substrate 112, membrane 114, lower backplate 116, and structural material 120. According to various embodiments, single backplate pumping speaker 110 operates as a capacitive plate transducer. A voltage applied through metallization 122 to membrane 114 and through metallization 124 to lower backplate 116 produces an attractive force between membrane 114 and lower backplate 116. The attractive force between membrane 114 and lower backplate 116 causes membrane 114 to deflect. The voltage applied to these two plates can be applied at a frequency in order to cause the membrane to oscillate. As the membrane oscillates, pressure changes are produced by the membrane in the air, which causes acoustic signals, e.g., sound waves. The application of the voltage to membrane 114 and lower backplate 116 may be tuned to produce various frequencies of oscillations and, consequently, acoustic signals. In various embodiments, the voltage may be applied to membrane 114 and lower backplate 116 in order to cause membrane 114 to oscillate according to carrier signal $C_{SIG}$ that produces pumping acoustic signal $PA_{SIG}$ as described hereinabove in reference to FIG. 2*b*.

According to various embodiments, substrate 112 is a semiconductor wafer. Substrate 112 may be formed of silicon for example. In other embodiments, substrate 112 is formed of other semiconductor materials such as gallium-arsenide, indium-phosphide, or other semiconductors, for example. In further embodiments, substrate 112 is a polymer substrate. In alternative embodiments, substrate 112 is a metal substrate. In other embodiments, substrate 112 is glass. For example, in a particular embodiment, substrate 112 is silicon dioxide. In various embodiments, substrate 112 includes cavity 118, which is formed in substrate 112 below the transducer plates that are formed by lower backplate 116 and membrane 114. Cavity 118 may be formed with a Bosch etch from the backside of substrate 112.

In various embodiments, structural material 120 is formed and patterned in multiple depositions to produce structural layers for supporting membrane 114 and lower backplate 116. In a specific embodiment, structural material 120 is formed using a tetraethyl orthosilicate (TEOS) deposition in order to form layers of silicon oxide. In other embodiments, structural material 120 is formed of other materials or multiple materials. In such embodiments, structural material 120 is formed of materials including polymers, semiconductors, oxides, nitrides, or oxynitrides.

In various embodiments, membrane 114 and lower backplate 116 are formed of conductive materials. In specific embodiments, membrane 114 and lower backplate 116 are formed of polysilicon. In other embodiments, membrane 114 and lower backplate 116 may be formed of doped semiconductors or metals, such as aluminum, platinum, or gold, for example. Further, membrane 114 and lower backplate 116 may be formed of multiple layers of different materials. In some embodiments, membrane 114 is deflectable and lower backplate 116 is rigid. Lower backplate 116 is perforated in various embodiments.

In various embodiments, metallization 122 is formed in structural material 120 and electrically contacts membrane 114, metallization 124 is formed in structural material 120 and electrically contacts lower backplate 116, and metallization 126 is formed in structural material 120 and electrically contacts substrate 112.

In various embodiments, membrane 114 is arranged over lower backplate 116 (as shown). In other embodiments, membrane 114 is arranged below lower backplate 116 (not shown). Similarly, a sound port may be included in packaging (not shown) around single backplate pumping speaker 110. The sound port may be formed below, and acoustically coupled to, cavity 118, such as in a circuit board attached to substrate 112. In other embodiments, the sound port may be formed above single backplate pumping speaker 110, such as in a package lid overlying single backplate pumping speaker 110, for example.

FIG. 3*b* shows double backplate pumping speaker 111 including substrate 112, membrane 114, lower backplate 116, upper backplate 117, and structural material 120. According to various embodiments, double backplate pumping speaker 111 includes elements as described hereinabove in reference to FIG. 3*a*, with the addition of upper backplate 117 and metallization 128 formed in structural material 120 and electrically contacting upper backplate 117. In various embodiments, upper backplate 117 may include materials and structures as similarly described hereinabove in reference to lower backplate 116 in FIG. 3*a*.

According to various embodiments, double backplate pumping speaker 111 operates as similarly described hereinabove in reference to single backplate pumping speaker 110, with the addition that upper backplate 117 generates attractive forces on membrane 114. In such embodiments, voltages may be applied between upper backplate 117 and membrane 114 or between lower backplate 116 and membrane 114 in order to generate attractive forces in either direction. Voltages are applied to membrane 114, lower backplate 116, and upper backplate 117 in order to cause membrane 114 to oscillate according to carrier signal $C_{SIG}$ that produces pumping acoustic signal $PA_{SIG}$ as described hereinabove in reference to FIG. 2*b*.

In various embodiments, amplitude $C_{amp}$ and the direction of carrier signal $C_{SIG}$ is adjusted in order to produce pumping acoustic signal $PA_{SIG}$ as described hereinabove in reference to FIG. 2*b*. Single backplate pumping speaker 110 and double backplate pumping speaker 111 may include asymmetric deflections, ventilation holes, or valves in order to control the direction of carrier signal $C_{SIG}$. Various further embodiments are described herein below as illustrative embodiment pumping mechanisms.

Figure 4A:
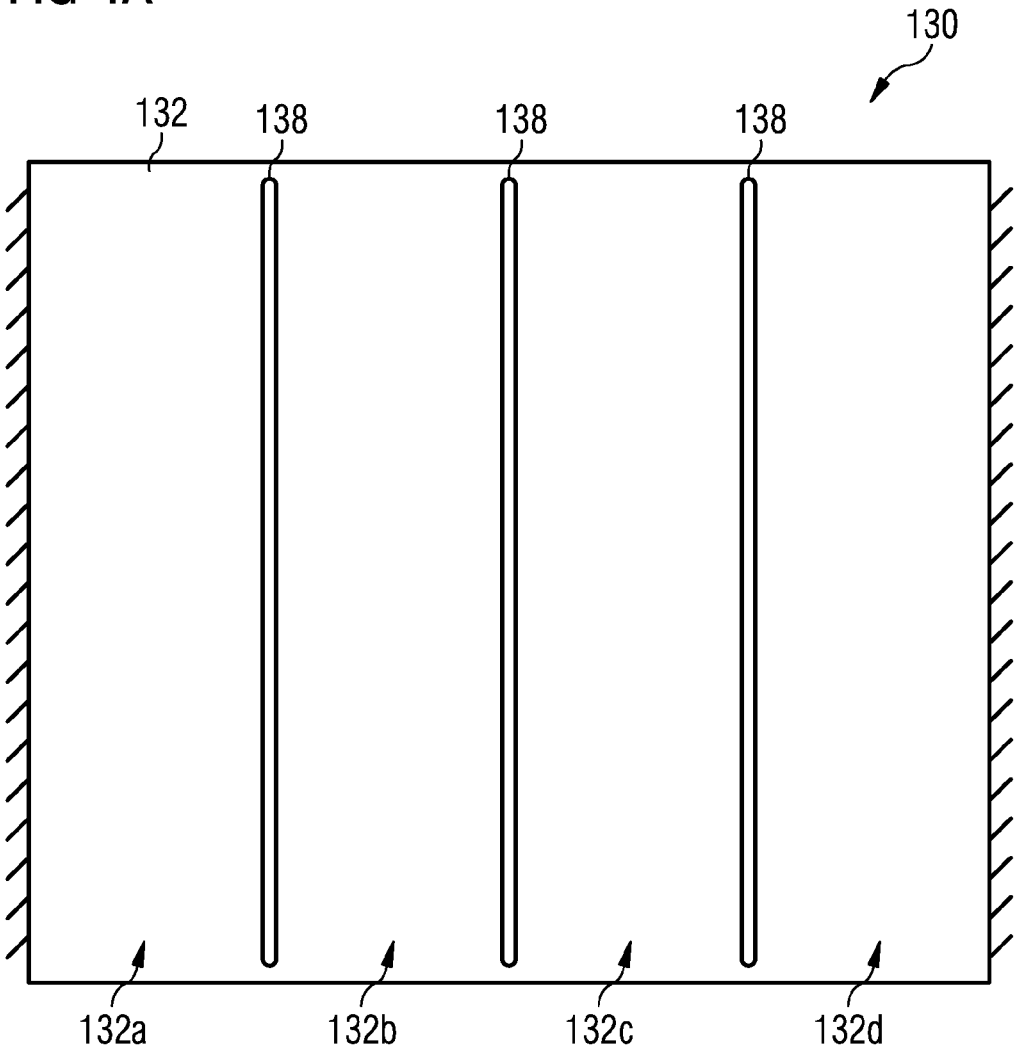
FIGS. 4*a*, 4*b*, 4*c*, and 4*d* illustrate cross-sectional views of another embodiment pumping speaker.
Figure 4B:
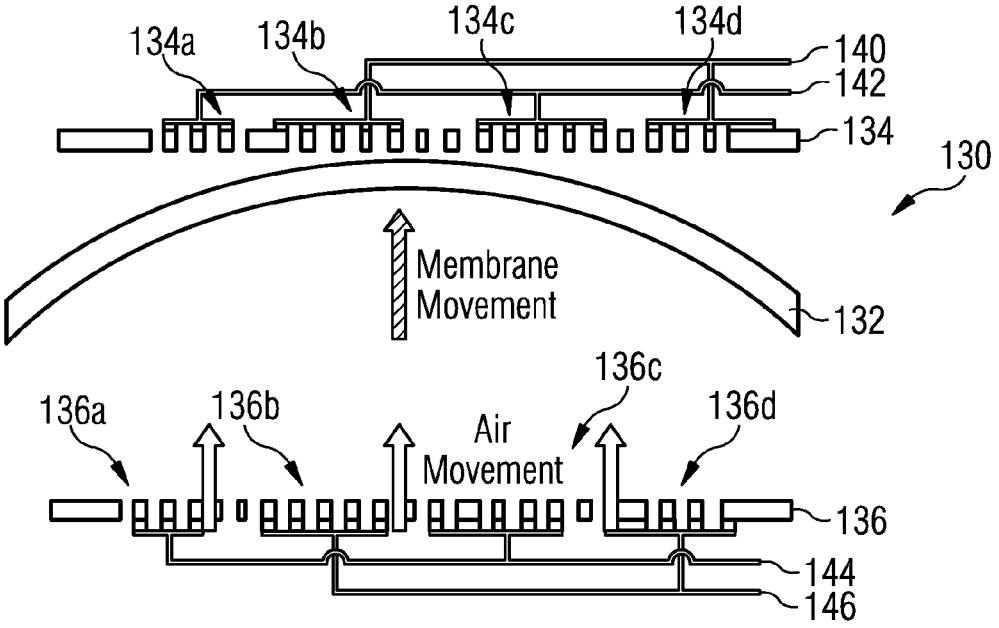
Figure 4C:
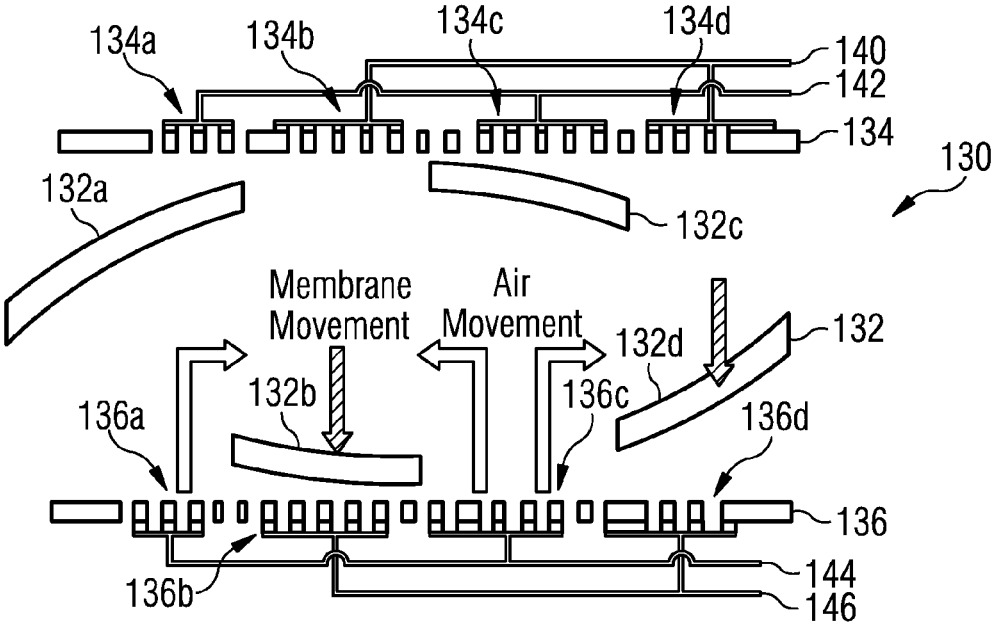
Figure 4D:
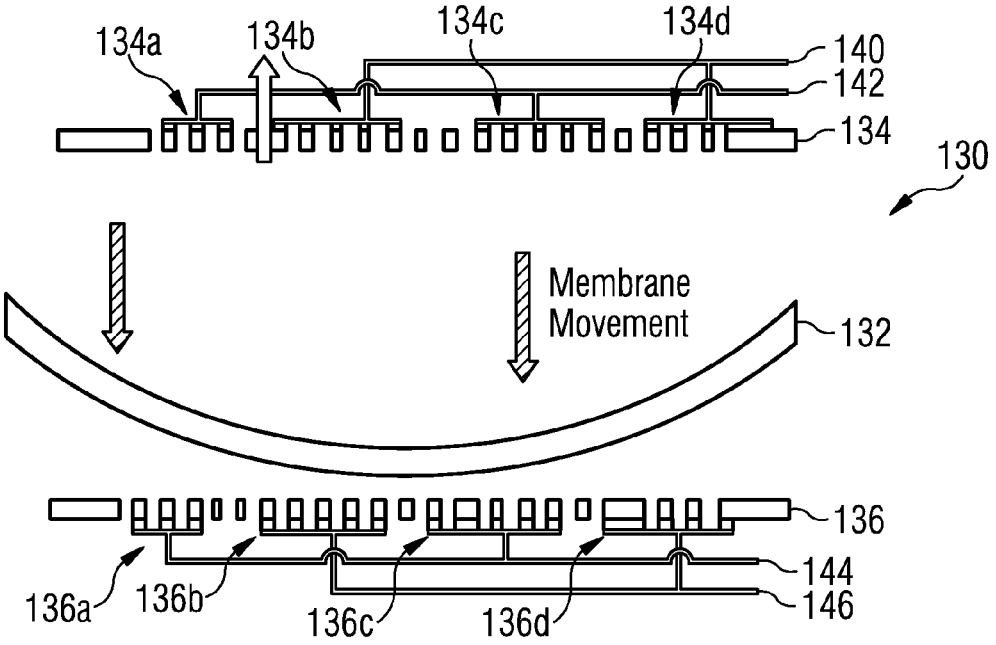

FIGS. 4*a*, 4*b*, 4*c*, and 4*d* illustrate a top view and cross-sectional views of another embodiment pumping speaker 130 including partitioned membrane 132, upper backplate 134, and lower backplate 136. According to various embodiments, partitioned membrane 132 includes partitions 132*a*, 132*b*, 132*c*, and 132*d* separated by slits 138 and able to move separately. Upper backplate 134 includes electrical partitions 134*a*, 134*b*, 134*c*, and 134*d*, which are able to generate different electric fields above partitions 132*a*, 132*b*, 132*c*, and 132*d*. For upper backplate 134, electrode 140 is coupled to electrical partitions 134*b* and 134*d* and electrode 142 is coupled to electrical partitions 134*a* and 134*c*. Similarly, lower backplate 136 includes electrical partitions 136*a*, 136*b*, 136*c*, and 136*d*, which are able to generate different electric fields below partitions 132*a*, 132*b*, 132*c*, and 132*d*. For lower backplate 136, electrode 144 is coupled to electrical partitions 136*a* and 136*c* and electrode 146 is coupled to electrical partitions 136*b* and 136*d*. FIG. 4*a* shows a top view of partitioned membrane 132 and FIGS. 4*b*, 4*c*, and 4*d* show cross-sectional views of pumping speaker 130 during different deflections of partitioned membrane 132 in order to illustrate a pumping action.

According to various embodiments, FIG. 4*b* shows partitioned membrane 132, with partitions 132*a*, 132*b*, 132*c*, and 132*d*, moving toward upper backplate 134 when a same voltage is applied to electrical partitions 134*a*, 134*b*, 134*c*, and 134*d* through electrodes 140 and 142. The same voltage applied to electrical partitions 134*a*, 134*b*, 134*c*, and 134*d* of upper backplate 134 generates an attractive force on each of partitions 132*a*, 132*b*, 132*c*, and 132*d*, causing partitioned membrane 132 to deflect. In such embodiments, air moves through perforations in lower backplate 136 as shown in FIG. 4*b*. The voltage applied to electrical partitions 136*a*, 136*b*, 136*c*, and 136*d* of lower backplate 136 may be zero or small when partitioned membrane 132 is moving toward upper backplate 134.

FIG. 4*c* shows partitions 132*b* and 132*d* of partitioned membrane 132 moving toward lower backplate 136 and partitions 132*a* and 132*c* remaining close to upper backplate 134. In such embodiments, a voltage is applied to electrical partitions 134*a* and 134*c* through electrode 142 that generates an attractive force on partitions 132*a* and 132*c* toward upper backplate 134 and a voltage is applied to electrical partitions 136*b* and 136*d* through electrode 146 that generates an attractive force on partitions 132*b* and 132*d* toward lower backplate 136. In such embodiments, air moves into the region behind partitions 132*b* and 132*d* as shown in FIG. 4*c*. The voltage applied to electrical partitions 134*b* and 134*d* of upper backplate 134 and electrical partitions 136*a* and 136*c* of lower backplate 136 may be zero or small when partitioned membrane 132 is moving as shown in FIG. 4*c*.

FIG. 4*d* shows partitioned membrane 132, with partitions 132*a*, 132*b*, 132*c*, and 132*d*, moving toward lower backplate 136 when a voltage is applied to electrical partitions 136*a*, 136*b*, 136*c*, and 136*d* through electrodes 144 and 146. As shown in FIG. 4*c*, partitions 132*b* and 132*d* may already be near lower backplate 136 and may not be moving or moving very little. The voltage applied to electrical partitions 136*a*, 136*b*, 136*c*, and 136*d* of lower backplate 136 generates an attractive force on each of partitions 132*a*, 132*b*, 132*c*, and 132*d*, causing partitioned membrane 132 to deflect. In such embodiments, air movement through perforations in upper backplate 134 may be small because of the air movement behind partitions 132*b* and 132*d* shown in FIG. 4*c*. The voltage applied to electrical partitions 134*a*, 134*b*, 134*c*, and 134*d* of upper backplate 134 may be zero or small when partitioned membrane 132 is moving toward lower backplate 136. Further, the voltage applied to electrical partitions 134*a*, 134*b*, 134*c*, and 134*d* of upper backplate 134 may be the same voltage or similar voltages for the different partitions. In still further embodiments, the voltage applied to electrical partitions 134*a*, 134*b*, 134*c*, and 134*d* of upper backplate 134 may be different for the different partitions.

According to various embodiments, by splitting the movement of partitioned membrane 132 into sections in one direction and combining the movement of partitioned membrane 132 in the other direction, a pumping action may be performed. Thus, as shown in FIGS. 4*b*, 4*c*, and 4*d*, the application of different voltages to electrodes 140, 142, 144, and 146 produces pumping in an upward direction, i.e., through upper backplate 134 while reducing back pumping in a downward direction. The voltages applied to electrodes 140, 142, 144, and 146 may be arranged to perform a pumping action in either direction by moving partitions 132*a*, 132*b*, 132*c*, and 132*d* of partitioned membrane 132 together in the direction of pumping and separately in the other direction. Thus, in various embodiments, pumping speaker 130 may be controlled by voltages applied through electrodes 140, 142, 144, and 146 in order to cause partitioned membrane 132 to oscillate according to carrier signal $C_{SIG}$ that produces pumping acoustic signal $PA_{SIG}$ as described hereinabove in reference to FIG. 2*b*. In such embodiments, both amplitude $C_{amp}$ and the direction of carrier signal $C_{SIG}$ may be adjusted for partitioned membrane 132 in order to produce pumping acoustic signal $PA_{SIG}$ as described hereinabove in reference to FIG. 2*b*.

Specifically, pumping speaker 130 is controlled to change the direction of pumping in accordance with producing pumping acoustic signal $PA_{SIG}$.

According to various embodiments, partitioned membrane 132 is fixed to anchored structures, such as a structural material, on two edges as shown in FIG. 4*a*. Further, the other two edges of partitioned membrane 132 may be free to move in some embodiments. In other embodiments, all the edges of partitioned membrane 132 may be fixed to anchored structures. In further embodiments, upper backplate 134 and lower backplate 136 may include additional electrical partitions or additional electrodes.

Figure 5A:
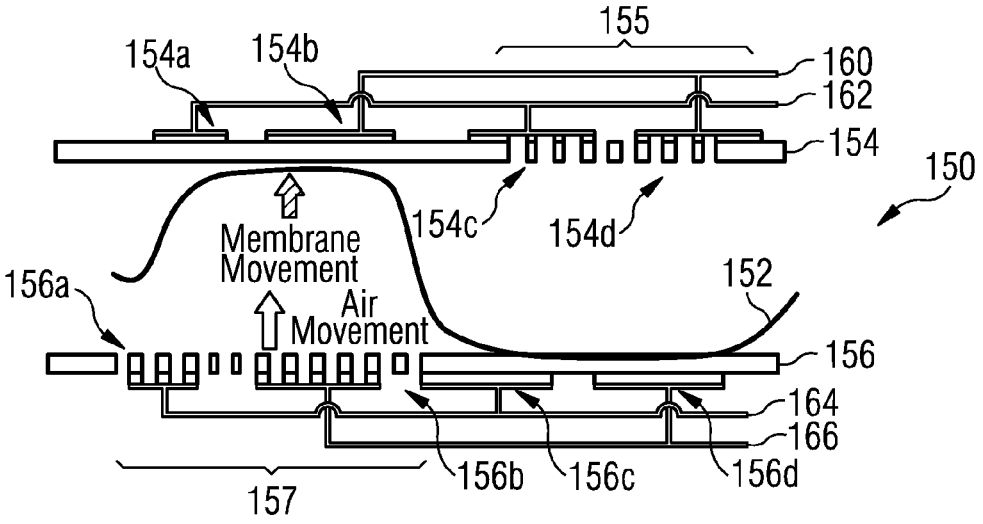
FIGS. 5*a*, 5*b*, 5*c*, and 5*d* illustrate cross-sectional views of a further embodiment pumping speaker.
Figure 5B:
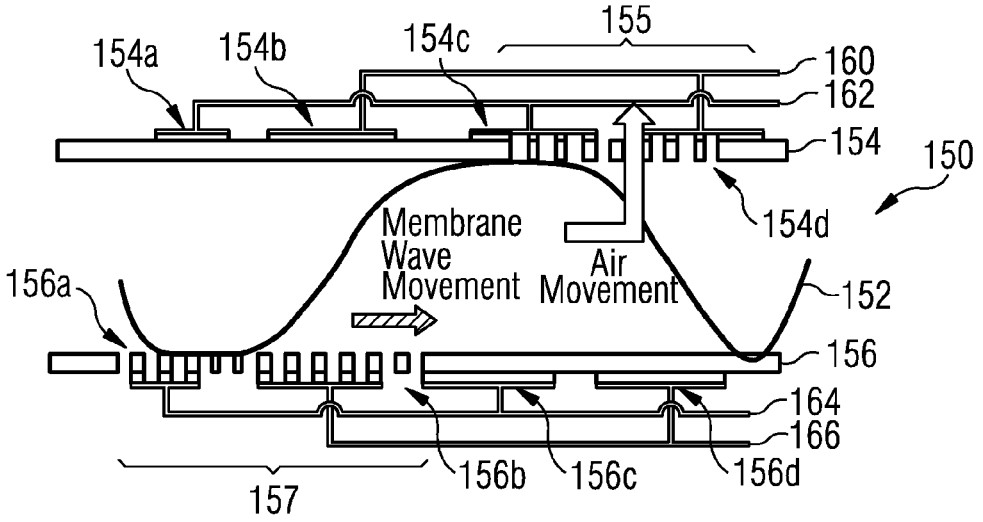

FIGS. 5*a* and 5*b* illustrate cross-sectional views of a further embodiment pumping speaker 150 including flexible membrane 152, upper backplate 154, and lower backplate 156. According to various embodiments, flexible membrane 152 deflects significantly in both directions and is not stiff or rigid. During operation, flexible membrane 152 may deflect with a wavelike or serpentine deflection as shown in FIGS. 5*a* and 5*b*. Similar to upper backplate 134 described hereinabove in reference to FIGS. 4*a*, 4*b*, 4*c*, and 4*d*, upper backplate 154 includes electrical partitions 154*a*, 154*b*, 154*c*, and 154*d*, which are able to generate different electric fields above flexible membrane 152. For upper backplate 154, electrode 160 is coupled to electrical partitions 154*b* and 154*d* and electrode 162 is coupled to electrical partitions 154*a* and 154*c*. Similar to lower backplate 136 described hereinabove in reference to FIGS. 4*a*, 4*b*, 4*c*, and 4*d*, lower backplate 156 includes electrical partitions 156*a*, 156*b*, 156*c*, and 156*d*, which are able to generate different electric fields below flexible membrane 152. For lower backplate 156, electrode 164 is coupled to electrical partitions 156*a* and 156*c* and electrode 166 is coupled to electrical partitions 156*b* and 156*d*. FIGS. 5*a* and 5*b* show cross-sectional views of pumping speaker 150 during different deflections of flexible membrane 152 in order to illustrate a pumping action.

According to various embodiments, electrodes 160, 162, 164, and 166 apply voltages to electrical partitions 154*a*, 154*b*, 154*c*, and 154*d* of upper backplate 154 and to electrical partitions 156*a*, 156*b*, 156*c*, and 156*d* of lower backplate 156 in order to generate a serpentine movement of flexible membrane 152 as shown in FIGS. 5*a* and 5*b*. In such embodiments, the serpentine motion includes moving flexible membrane 152 upwards over perforated section 157 of lower backplate 156 in order to move air through perforated section 157 and into the space between upper backplate 154 and lower backplate 156 (as shown in FIG. 5*a*). The serpentine motion then includes moving flexible membrane 152 upwards under perforated section 155 of upper backplate 154 in order to move air from the space between upper backplate 154 and lower backplate 156 out through perforated section 155 (as shown in FIG. 5*b*). In such embodiments, flexible membrane 152 may include holes or slits (not shown) in the membrane. For example, membrane 152 may include holes or slits around the edge of flexible membrane 152 or in the center of flexible membrane 152. In other particular embodiments, a support structures connected around the edge of the membrane includes holes of slits (not shown). Based on the holes or slits in flexible membrane 152, air is able to pass through the holes during pumping of flexible membrane 152.

In various embodiments, the sequence of voltages applied through electrodes 160, 162, 164, and 166 may be applied in a reverse order in order to move air in the opposite direction. In various embodiments, pumping speaker 150 may be controlled by voltages applied through electrodes 160, 162, 164, and 166 in order to cause flexible membrane 152 to oscillate according to carrier signal $C_{SIG}$ that produces pumping acoustic signal $PA_{SIG}$ as described hereinabove in reference to FIG. 2*b*. In such embodiments, both amplitude $C_{amp}$ and the direction of carrier signal $C_{SIG}$ may be adjusted for flexible membrane 152 in order to produce pumping acoustic signal $PA_{SIG}$ as described hereinabove in reference to FIG. 2*b*. Specifically, pumping speaker 150 is controlled to change the direction of pumping in accordance with producing pumping acoustic signal $PA_{SIG}$. In various embodiments, pumping speaker 150 may be referred to as a serpentine pump.

According to some embodiments, flexible membrane 152 is very flexible or soft. Thus, flexible membrane 152 may be formed of a thin layer of silicon or polysilicon. In some embodiments, flexible membrane 152 is less than 700 nm thick. In one particular embodiment, flexible membrane 152 is 660 nm thick. In other embodiments, flexible membrane 152 is less than 500 nm thick. In various other embodiments, flexible membrane 152 may be formed of a conductive material, such as a semiconductor material or a metal, for example. In some specific embodiments, flexible membrane 152 is formed of carbon or silicon nitride with a layer of polysilicon.

In some embodiments, additional electrodes may be included in order to couple electrical partitions 154*a*, 154*b*, 154*c*, and 154*d* or 156*a*, 156*b*, 156*c*, and 156*d* to independent electrodes. Further, upper backplate 154 and lower backplate 156 may include additional electrical partitions or additional electrodes.

Figure 5C:
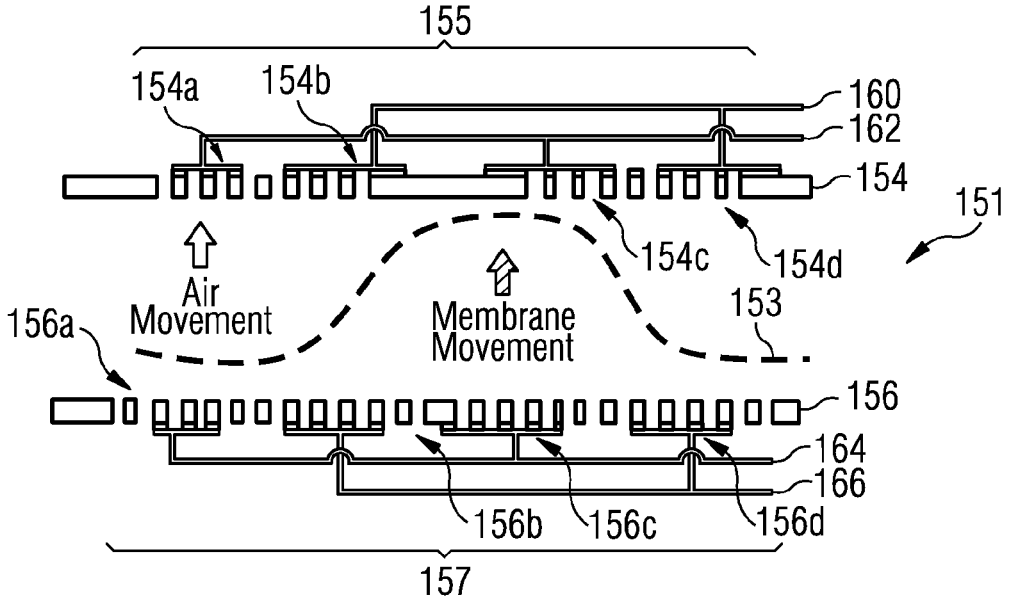
Figure 5D:
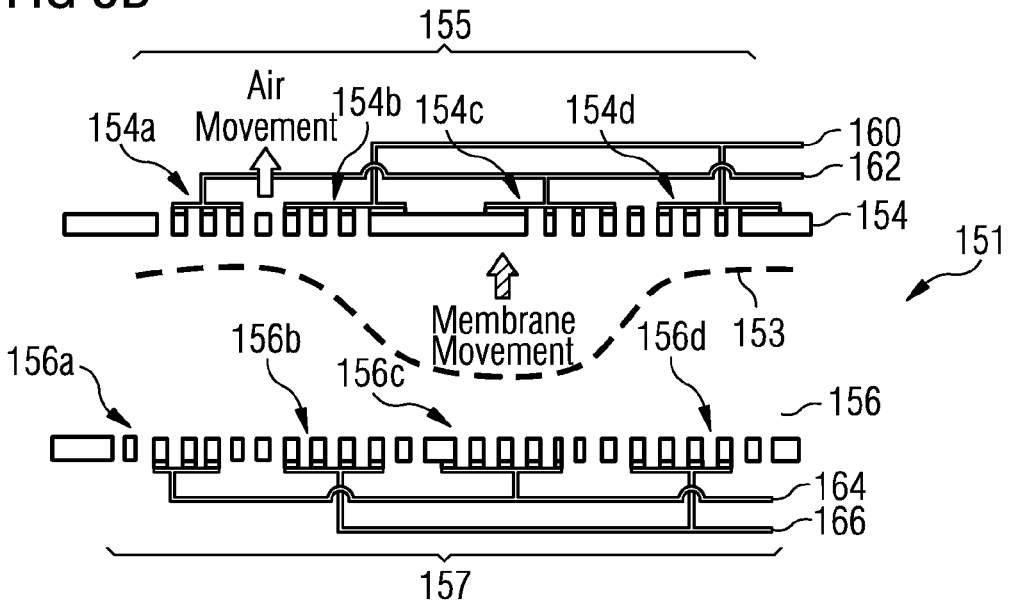

FIGS. 5*c* and 5*d* illustrate cross-sectional views of embodiment pumping speaker 151, which is a general version of pumping speaker 150, including flexible membrane 153, upper backplate 154, and lower backplate 156. According to various embodiments, flexible membrane 153 may include any of the features of flexible membrane 152 and may include holes or slits, for example. In such embodiments, flexible membrane 153 may exhibit any type of asymmetric motion that produces an asymmetric pumping action, resulting in directional pumping. In some embodiments, flexible membrane 153 may include ventilation holes or slits in the center or around the edge of flexible membrane 153. In various embodiments, perforated section 155 and perforated section 157 may extend across any portion of upper backplate 154 and lower backplate 156, respectively, depending on various embodiment applications. The asymmetric motion of flexible membrane 153 may be asymmetric in either direction to produce pumping in either direction through perforated section 155 and perforated section 157.

Figure 6A:
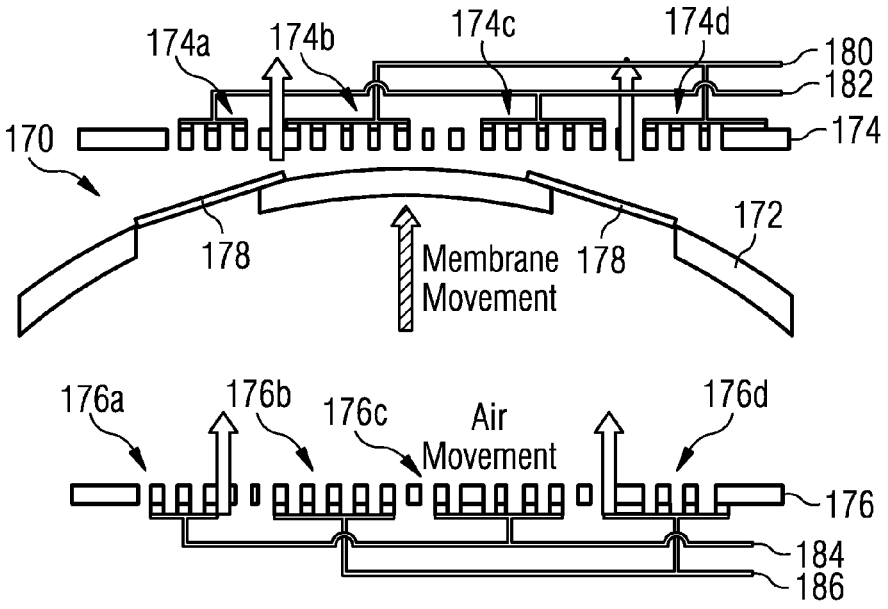
FIGS. 6*a* and 6*b* illustrate cross-sectional views of still another embodiment pumping speaker.
Figure 6B:
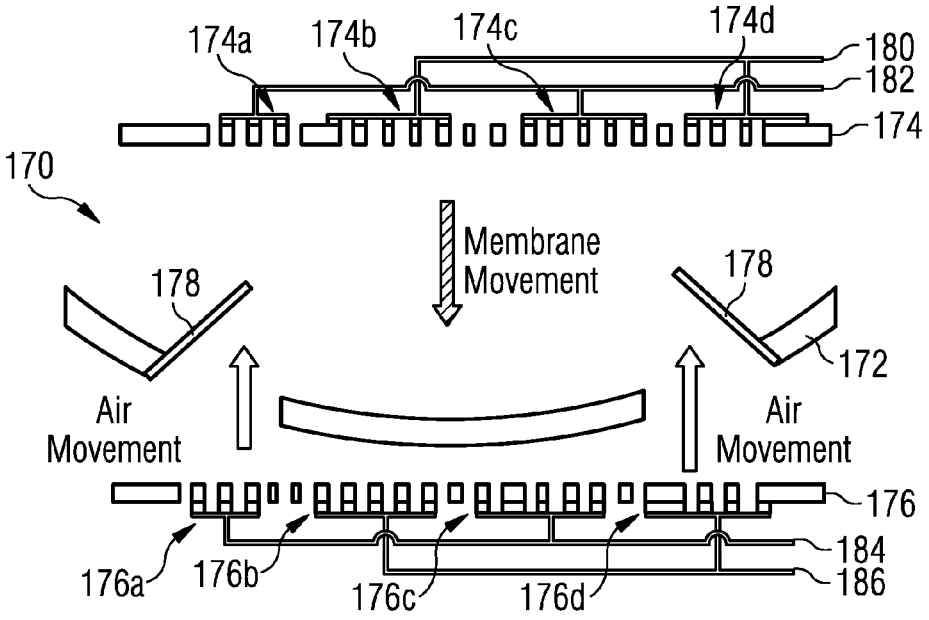

FIGS. 6*a* and 6*b* illustrate cross-sectional views of still another embodiment pumping speaker 170 including membrane 172, upper backplate 174, and lower backplate 176. According to various embodiments, membrane 172 includes valves 178 to control pumping direction. During operation, membrane 172 may deflect in both directions while valves 178 remain closed in one direction and open in the other direction in order to control the direction of pumping. FIGS. 6*a* and 6*b* show cross-sectional views of pumping speaker 170 during different deflections of membrane 172 in order to illustrate a pumping action.

Similar to upper backplate 134 described hereinabove in reference to FIGS. 4*a*, 4*b*, 4*c*, and 4*d*, upper backplate 174 includes electrical partitions 174*a*, 174*b*, 174*c*, and 174*d*, which are able to generate different electric fields above membrane 172. For upper backplate 174, electrode 180 is coupled to electrical partitions 174*b* and 174*d* and electrode 182 is coupled to electrical partitions 174*a* and 174*c*. Similar to lower backplate 136 described hereinabove in reference to FIGS. 4*a*, 4*b*, 4*c*, and 4*d*, lower backplate 176 includes electrical partitions 176*a*, 176*b*, 176*c*, and 176*d*, which are able to generate different electric fields below membrane 172. For lower backplate 176, electrode 184 is coupled to electrical partitions 176*a* and 176*c* and electrode 186 is coupled to electrical partitions 176*b* and 176*d*.

According to various embodiments, electrodes 180, 182, 184, and 186 apply voltages to electrical partitions 174*a*, 174*b*, 174*c*, and 174*d* of upper backplate 174 and to electrical partitions 176*a*, 176*b*, 176*c*, and 176*d* of lower backplate 176 in order to generate a movement of membrane 172 as shown in FIGS. 6*a* and 6*b*. In such embodiments, the upward motion of membrane 172 generates pumping in an upward direction through perforations in upper backplate 174 when valves 178 remain closed. The following downward motion of membrane 172 does not generate pumping in a downward direction through perforations in lower backplate 176 because valves 178 are opened in order to allow air to move through valves 178. In various different embodiments, valves 178 are configured to open or close during upward or downward motions in order to provide pumping through the movements of membrane 172 in either direction. In some such embodiments, valves 178 are configured to open only during downward motion of membrane 172. In other such embodiments, valves 178 are configured to open only during upward motion of membrane 172. In further embodiments, valves 178 are configured to open during upward or downward motion of membrane 172.

In various embodiments, valves 178 may be controlled by applying voltages to open or close valves 178. In other embodiments, valves 178 may be configured to open and close at a certain resonant frequency while membrane 172 oscillates at a different frequency. In such embodiments, the resonant frequency of membrane 172 may be different from the resonant frequency of valves 178 and the difference may be used to control the opening and close of valves 178 in relation to the oscillations of membrane 172.

In various embodiments, pumping speaker 170 may be controlled by voltages applied through electrodes 180, 182, 184, and 186 in order to cause membrane 172 to oscillate according to carrier signal $C_{SIG}$ that produces pumping acoustic signal $PA_{SIG}$ as described hereinabove in reference to FIG. 2*b*. In such embodiments, both the amplitude $C_{amp}$ and the direction of carrier signal $C_{SIG}$ may be adjusted by controlling the oscillations of membrane 172 and the opening and closing of valves 178 in order to produce pumping acoustic signal $PA_{SIG}$ as described hereinabove in reference to FIG. 2*b*. Specifically, pumping speaker 170 is controlled to change the direction of pumping, by controlling valves 178, in accordance with producing pumping acoustic signal $PA_{SIG}$.

According to some embodiments, valves 178 may be included in upper backplate 174 or lower backplate 176. In such embodiments, valves 178 may be omitted from membrane 172 or may be additionally included in membrane 172. In some embodiments, additional electrodes may be included in order to couple electrical partitions 174*a*, 174*b*, 174*c*, and 174*d* or 176*a*, 176*b*, 176*c*, and 176*d* to independent electrodes. Further, upper backplate 174 and lower backplate 176 may include additional electrical partitions or additional electrodes.

Figure 7A:
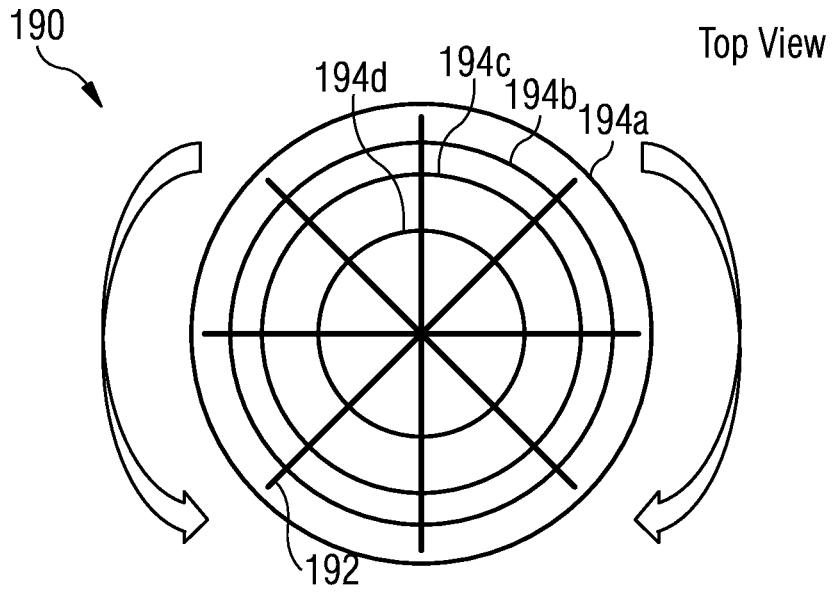
FIGS. 7*a* and 7*b* illustrate a top view and a cross-sectional view of a still further embodiment pumping speaker.
Figure 7B:
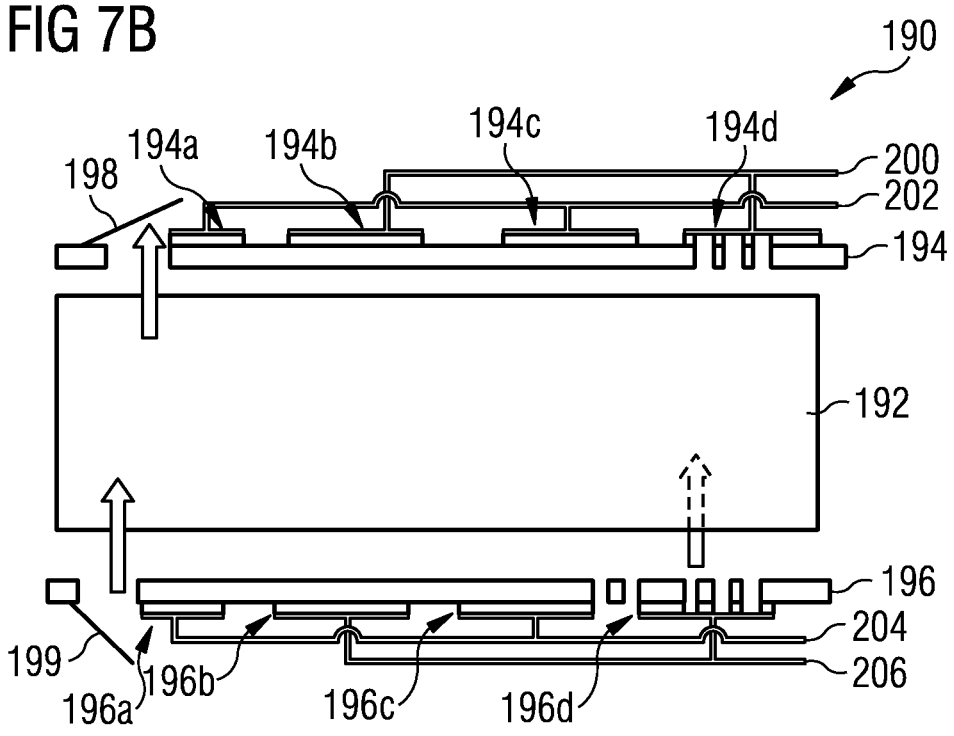

FIGS. 7*a* and 7*b* illustrate a top view and a cross-sectional view of a still further embodiment pumping speaker 190 including rotor 192, top stator 194, and bottom stator 196. According to various embodiments, rotor 192 includes multiple chambers and rotates based on applied voltages from top stator 194 and bottom stator 196. As rotor 192 oscillates back and worth, valve 198 in top stator 194 and valve 199 in bottom stator 196 are opened and closed to control pumping direction of pumping speaker 190. During operation, rotor 192 may deflect in both directions while valve 198 and valve 199 alternatingly open and close in order to control the direction of pumping. According to various embodiments, pumping speaker 190 may be referred to as a rotor pump.

Similar to upper backplate 134 described hereinabove in reference to FIGS. 4*a*, 4*b*, 4*c*, and 4*d*, top stator 194 includes electrical partitions 194*a*, 194*b*, 194*c*, and 194*d*, which are able to generate different electric fields above rotor 192. For top stator 194, electrode 200 is coupled to electrical partitions 194*b* and 194*d* and electrode 202 is coupled to electrical partitions 194*a* and 194*c*. Similar to lower backplate 136 described hereinabove in reference to FIGS. 4*a*, 4*b*, 4*c*, and 4*d*, bottom stator 196 includes electrical partitions 196*a*, 196*b*, 196*c*, and 196*d*, which are able to generate different electric fields below rotor 192. For bottom stator 196, electrode 204 is coupled to electrical partitions 196*a* and 196*c* and electrode 206 is coupled to electrical partitions 196*b* and 196*d*.

According to various embodiments, electrodes 200, 202, 204, and 206 apply voltages to electrical partitions 194*a*, 194*b*, 194*c*, and 194*d* of top stator 194 and to electrical partitions 196*a*, 196*b*, 196*c*, and 196*d* of bottom stator 196 in order to generate a movement of rotor 192 as shown in FIGS. 7*a* and 7*b*. In such embodiments, the motion of rotor 192 generates pumping in either direction by opening and closing valve 198 or valve 199. For example, an upward pumping may be generated by opening valve 198 while rotor 192 is rotating to force air movement through valve 198 and closing valve 198 while rotor 192 is rotating the other direction to prevent air from being pulled back through valve 198. Similarly, a downward pumping may be generated by opening valve 199 while rotor 192 is rotating to force air movement through valve 199 and closing valve 199 while rotor 192 is rotating the other direction to prevent air from being pulled back through valve 199.

In various different embodiments, valve 198 and valve 199 are configured to open or close during upward or downward motions in order to provide pumping through the movements of rotor 192 in either direction. In some such embodiments, valve 198 and valve 199 are configured to open only during clockwise motion of rotor 192. In other such embodiments, valve 198 and valve 199 are configured to open only during counterclockwise motion of rotor 192. In further embodiments, valve 198 and valve 199 are configured to open during clockwise or counterclockwise motion of rotor 192 and may be controlled accordingly. In various embodiments, valve 198 and valve 199 may be controlled by applying voltages to open or close valve 198 and valve 199. In other embodiments, valve 198 and valve 199 may be configured to open only for air flow in one direction, i.e., valve 198 and valve 199 may be one way valves.

In various embodiments, pumping speaker 190 may be controlled by voltages applied through electrodes 200, 202, 204, and 206 in order to cause rotor 192 to oscillate according to carrier signal $C_{SIG}$ that produces pumping acoustic signal $PA_{SIG}$ as described hereinabove in reference to FIG. 2*b*. In such embodiments, both the amplitude $C_{amp}$ and the direction of carrier signal $C_{SIG}$ may be adjusted by controlling the oscillations of rotor 192 and the opening and closing of valve 198 and valve 199 in order to produce pumping acoustic signal $PA_{SIG}$ as described hereinabove in reference to FIG. 2*b*. Specifically, pumping speaker 190 is controlled to change the direction of pumping, by controlling valve 198 and valve 199, in accordance with producing pumping acoustic signal $PA_{SIG}$. In specific embodiments, rotor 192 is controlled to oscillate at a frequency above 50 kHz.

According to some embodiments, additional valves may be included in top stator 194 or bottom stator 196. In some embodiments, additional electrodes may be included in order to couple electrical partitions 194*a*, 194*b*, 194*c*, and 194*d* or electrical partitions 196*a*, 196*b*, 196*c*, and 196*d* to independent electrodes. Further, top stator 194 and bottom stator 196 may include additional electrical partitions or additional electrodes.

Figure 8A:
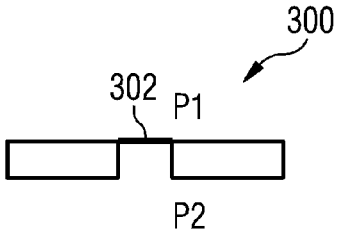
FIGS. 8*a*, 8*b*, 8*c*, 8*d*, 8*e*, and 8*f* illustrate cross-sectional views of valve systems for embodiment pumping speakers.
Figure 8B:
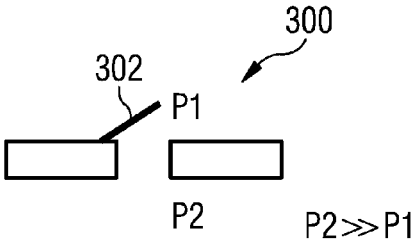

FIGS. 8*a*, 8*b*, 8*c*, 8*d*, 8*e*, and 8*f* illustrate cross-sectional views of valve systems 300, 301, and 303 for embodiment pumping speakers. FIGS. 8*a* and 8*b* illustrate self-closing valve system 300 including valve 302. According to various embodiments, valve 302 closes automatically unless a large pressure difference exists between pressure P1 and pressure P2. As shown in FIG. 8*a*, valve 302 remains closed for pressure P1 and P2. When pressure P2 is much greater than pressure P1, valve 302 is forced open by the pressure difference as shown in FIG. 8*b*.

Figure 8C:
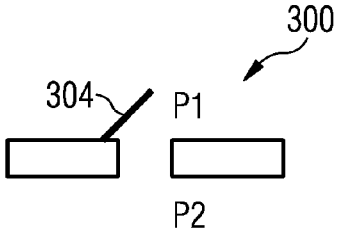
Figure 8D:
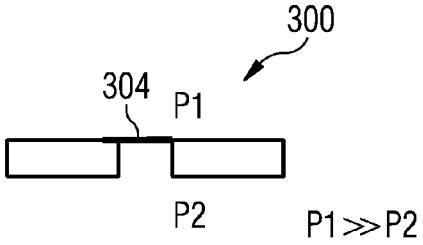

FIGS. 8*c* and 8*d* illustrate self-opening valve system 301 including valve 304. According to various embodiments, valve 304 opens automatically unless a large pressure difference exists between pressure P1 and pressure P2. As shown in FIG. 8*c*, valve 304 remains open for pressure P1 and P2. When pressure P1 is much greater than pressure P2, valve 304 is forced closed by the pressure difference as shown in FIG. 8*d*.

Figure 8E:
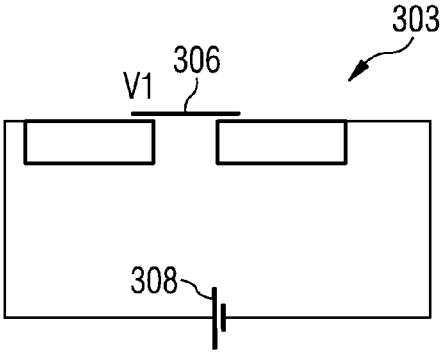
Figure 8F:
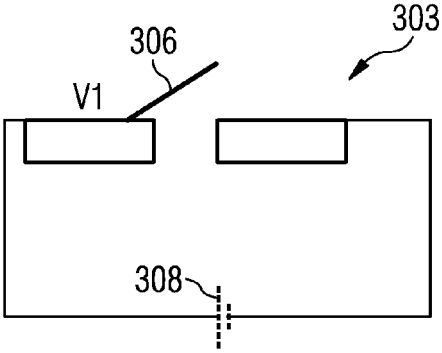

FIGS. 8*e* and 8*f* illustrate voltage controlled valve system 303 including valve 306 and voltage supply 308 for controlling voltage V1 applied to valve 306. According to various embodiments, valve 306 is closed when voltage supply 308 is active to apply voltage V1 across valve 306 as shown in FIG. 8*e*. Valve 306 is opened when voltage supply 308 is inactive or disconnected and no voltage is applied across valve 306 as shown in FIG. 8*f*.

The materials and structures of various self-closing valves, self-opening valves, and voltage controlled valves are numerous and known by those of skill in the art. Such numerous material and structure implementations are included in various embodiments.

Figure 9A:
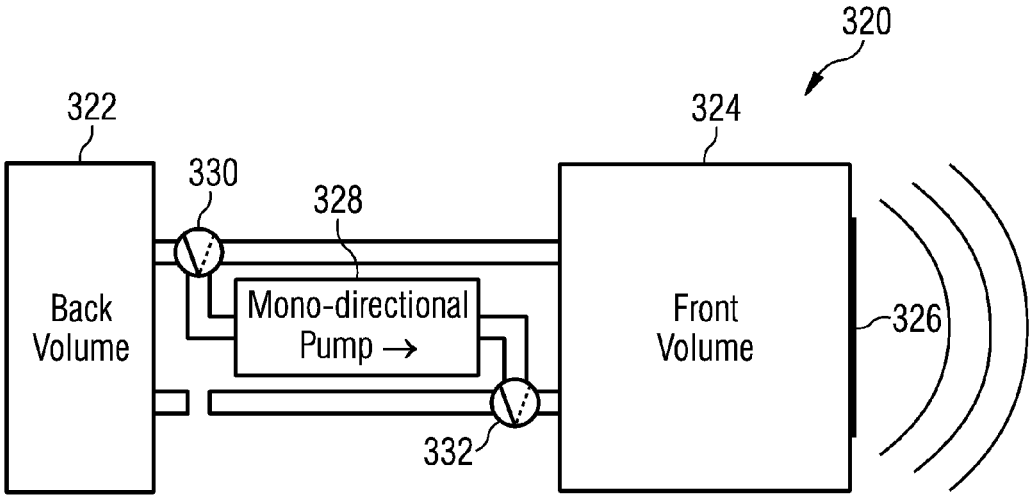
FIGS. 9*a* and 9*b* illustrate system diagrams of embodiment pumping speaker systems.
Figure 9B:
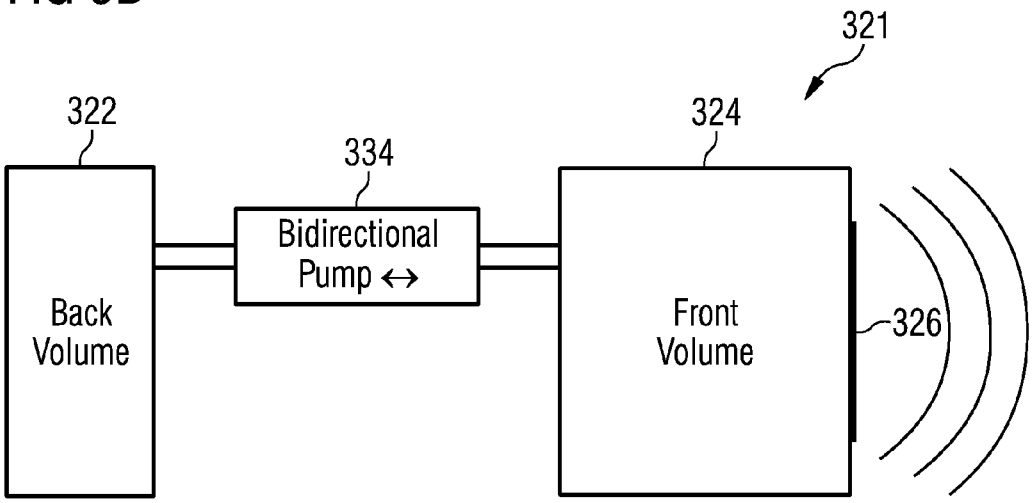

FIGS. 9*a* and 9*b* illustrate system diagrams of embodiment pumping speaker system 320 and embodiment pumping speaker system 321. Pumping speaker system 320 includes back volume 322, front volume 324, filter membrane 326, mono-directional pump 328, valve 330, and valve 332. According to various embodiments, mono-directional pump 328, valve 330, and valve 332 operate as described herein above in reference to the other figures to generate carrier signal $C_{SIG}$ that produces pumping acoustic signal $PA_{SIG}$ as described hereinabove in reference to FIG. 2*b*. In such embodiments, both the amplitude $C_{amp}$ and the direction of carrier signal $C_{SIG}$ may be adjusted by mono-directional pump 328, valve 330, and valve 332 in order to produce pumping acoustic signal $PA_{SIG}$ as described hereinabove in reference to FIG. 2*b*. In such embodiments, valve 330 and valve 332 are controlled in order to control the direction of pumping between back volume 322 and front volume 324. By controlling valve 330 and valve 332, pumping speaker system 320 is able to provide bidirectional pumping, and thus control the direction of pumping in order to generate pumping acoustic signal $PA_{SIG}$, while using mono-directional pump 328.

According to various embodiments, the direction and magnitude of pumping is adjusted, as described hereinabove, in order to produce pumping acoustic signal $PA_{SIG}$ out of front volume 324. In such embodiments, filter membrane 326 may be included at an interface or output of front volume 324 in order to provide low pass filtering of the generated signal and to provide additional dust and particulate protection for mono-directional pump 328, valve 330, and valve 332. Filter membrane 326 passes frequencies in the audible frequency range and filters frequencies above the audible frequency range. In alternative embodiments, filter membrane 326 may also pass frequencies above the audible frequency range, for example in ultrasound or near field detection applications. Further, mono-directional pump 328, valve 330, and valve 332 may be sensitive to damage from particles or dust in the air and filter membrane 326 may provide additional protection from dust, dirt, or other particulates in the air.

Pumping speaker system 321 in FIG. 9*b* includes back volume 322, front volume 324, filter membrane 326, and bidirectional pump 334. According to various embodiments, pumping speaker system 321 with bidirectional pump 334 operates as described in reference to pumping speaker system 320 and mono-directional pump 328 where valve 330 and valve 332 are omitted. In such embodiments, bidirectional pump 334 is able to provide bidirectional pumping between back volume 322 and front volume 324, without valve 330 or valve 332, and thus is able to control the direction of pumping in order to generate pumping acoustic signal $PA_{SIG}$ as described hereinabove in reference to FIGS. 2*b* and 9*a*.

In various embodiments, back volume 322 and front volume 324 may be unsealed volumes, such as open volumes in a device package. In some embodiments, back volume 322 and front volume 324 may have designed shapes for different applications. For example, back volume 322 and front volume 324 may arranged to improve acoustic pumping efficiency, system cost, or system size. Thus, in various embodiments, back volume 322 and front volume 324 may have any type of shape.

Figure 10:
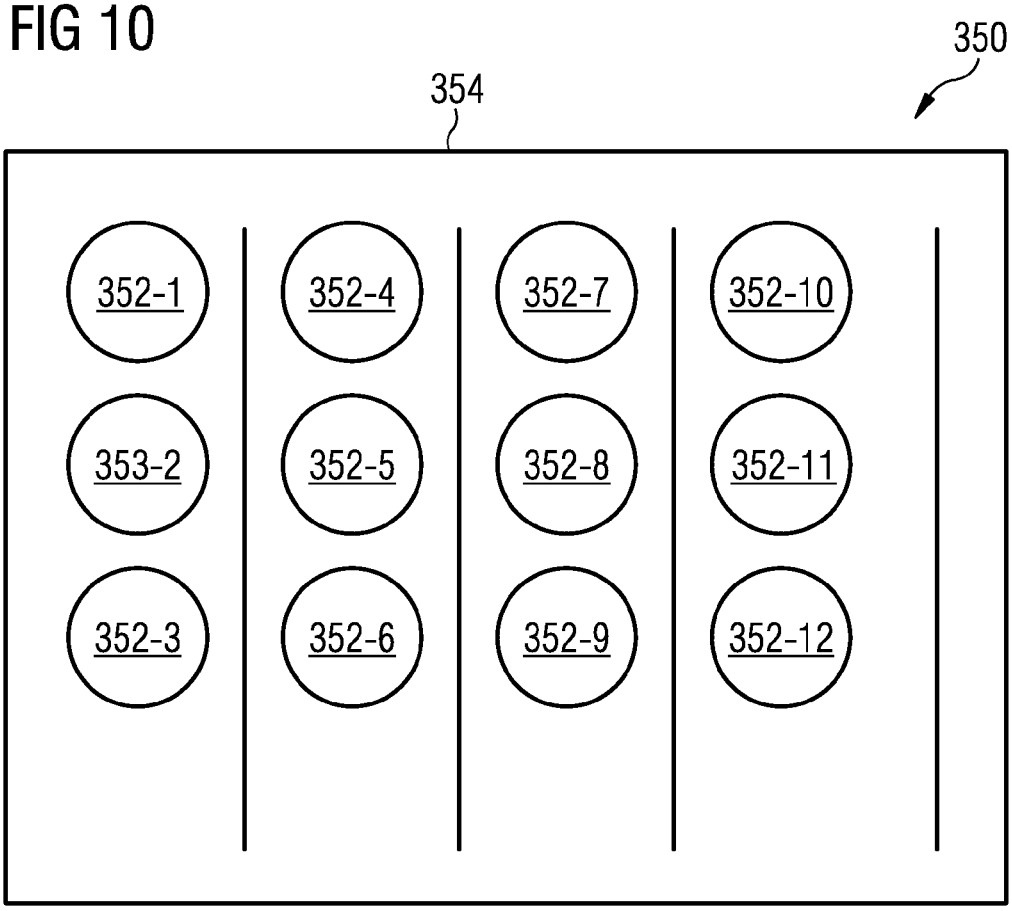
FIG. 10 illustrates a system diagram of another embodiment pumping speaker system.

FIG. 10 illustrates a system diagram of another embodiment pumping speaker system 350 with a microspeaker array including microspeakers 352-1, 352-2, 352-3, 352-4, 352-5, 352-6, 352-7, 352-8, 352-9, 352-10, 352-11, and 352-12. According to various embodiments, microspeakers 352-1, 352-2, 352-3, 352-4, 352-5, 352-6, 352-7, 352-8, 352-9, 352-10, 352-11, and 352-12 may each include any of the various embodiment microspeakers and micropumps described herein. In some embodiments, each microspeaker in pumping speaker system 350 includes a same embodiment microspeaker. In other embodiments, pumping speaker system 350 may include multiple types of embodiment microspeakers.

Pumping speaker system 350 is illustrated with 12 microspeakers 352-1, 352-2, 352-3, 352-4, 352-5, 352-6, 352-7, 352-8, 352-9, 352-10, 352-11, and 352-12, but pumping speaker system 350 may include any number of microspeakers in an array in other embodiments. For example, pumping speaker system 350 may include between 2 and 24 microspeakers in some embodiments. In other embodiments, pumping speaker system 350 may include more than 24 microspeakers. In various embodiments, microspeakers 352-1, 352-2, 352-3, 352-4, 352-5, 352-6, 352-7, 352-8, 352-9, 352-10, 352-11, and 352-12 are formed in substrate 354. In one embodiment, substrate 354 is a single semiconductor die. In another embodiment, substrate 354 is a printed circuit board (PCB).

According to various embodiments, a microspeaker array, such as included in pumping speaker system 350, generates signals with higher combined amplitude compared to a single microspeaker. In such embodiments, the microspeakers formed in an array may together produce acoustic signals with higher SPLs. In particular embodiments, pumping speaker system 350 may include various microspeakers that are tuned to produce acoustic signals in different frequency ranges with better performance. For example, microspeakers 352-1, 352-2, 352-3, 352-4, 352-5, and 352-6 may be tuned to produce frequencies between 20 Hz and 1 kHz with better performance and microspeakers 352-7, 352-8, 352-9, 352-10, 352-11, and 352-12 may be tuned to produce frequencies between 1 kHz and 20 kHz with better performance. Thus, a microspeaker array may be tuned to operate with better performance and efficiency, in some embodiments, by using a heterogeneous selection of microspeakers instead of a homogeneous selection of microspeakers.

Figure 11:
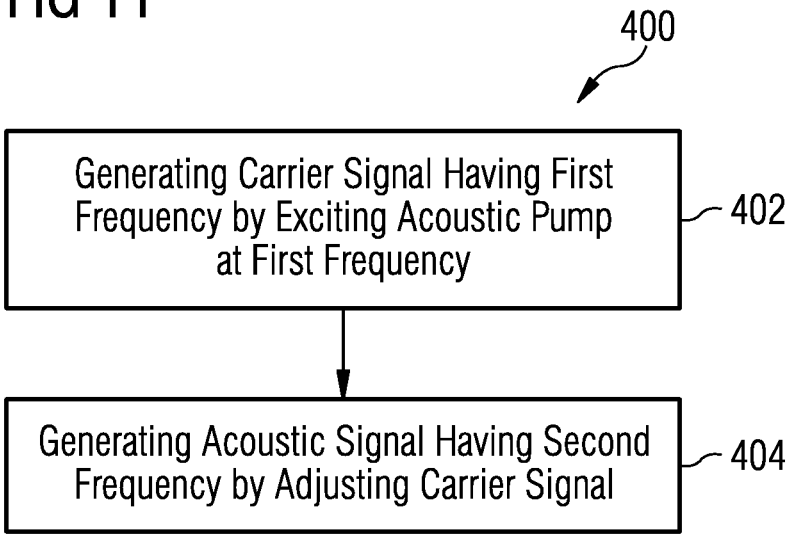
FIG. 11 illustrates a system block diagram of an embodiment method of operation for a pumping speaker.

FIG. 11 illustrates a system block diagram of an embodiment method of operation 400 for a pumping speaker. According to various embodiments, method of operation 400 includes steps 402 and 404 and includes a method of operating a speaker that includes an acoustic pump. Step 402 includes generating a carrier signal having a first frequency by exciting the acoustic pump at the first frequency. The first frequency is outside an audible frequency range in such embodiments. Step 404 includes generating an acoustic signal having a second frequency by adjusting the carrier signal. The adjustments to the carrier signal are performed at the second frequency. In such embodiments, the second frequency is inside the audible frequency range.

According to some embodiments, generating the acoustic signal by adjusting the carrier signal in step 404 includes adjusting the magnitude of the carrier signal according to the second frequency and adjusting the direction of pumping for the acoustic pump according to the second frequency. Further steps may be included in method of operation 400 in various additional embodiments.

According to an embodiment, a method of operating a speaker with an acoustic pump includes generating a carrier signal having a first frequency by exciting the acoustic pump at the first frequency and generating an acoustic signal having a second frequency by adjusting the carrier signal. In such embodiments, the first frequency is outside an audible frequency range and the second frequency is inside the audible frequency range. Adjusting the carrier signal includes performing adjustments to the carrier signal at the second frequency. Other embodiments include corresponding systems and apparatus, each configured to perform corresponding embodiment methods.

Implementations may include one or more of the following features. In various embodiments, generating the acoustic signal by adjusting the carrier signal includes adjusting a magnitude of the carrier signal according to the second frequency and adjusting a direction of pumping for the acoustic pump according to the second frequency. In some embodiments, the second frequency includes a plurality of frequencies inside the audible frequency range and the acoustic signal includes a plurality of sounds having the plurality of frequencies inside the audible frequency range. Exciting the acoustic pump may include exciting a micropump structure.

In various embodiments, the first frequency is above 100 kHz and the second frequency is below 23 kHz. In some embodiments, the first frequency is selected to match a resonant frequency of the acoustic pump. In particular embodiments, the first frequency is held constant and the second frequency is varied. In further embodiments, the method further includes, before generating the carrier signal, exciting the acoustic pump at a plurality of frequencies, measuring a plurality of responses of the acoustic pump corresponding to the plurality of frequencies, and determining a resonant frequency of the acoustic pump based on measuring the plurality of responses. In still further embodiments, the method further includes, before generating the carrier signal, setting the first frequency to the resonant frequency. According to some embodiments, the method further includes, before generating the carrier signal, tuning the resonant frequency of the acoustic pump by adjusting mechanical components within the acoustic pump.

According to an embodiment, a microspeaker includes an acoustic micropump structure configured to pump at a first frequency above an upper audible frequency limit and generate an acoustic signal by adjusting a magnitude and a direction of the pumping according to a second frequency below the upper audible frequency limit. Other embodiments include corresponding systems and apparatus, each configured to perform corresponding embodiment methods.

Implementations may include one or more of the following features. In various embodiments, the microspeaker further includes an integrated circuit coupled to the acoustic micropump structure. The integrated circuit is configured to operate the acoustic micropump structure at a plurality of test frequencies, measure a plurality of frequency responses of the acoustic micropump structure corresponding to the plurality of test frequencies, determine a resonant frequency of the acoustic micropump structure based on measuring the plurality of frequency responses, and set the first frequency based on the resonant frequency.

In various embodiments, the acoustic micropump structure includes a deflectable membrane partitioned into a plurality of sections with slits separating the plurality of sections. In some embodiments, the acoustic micropump structure includes a serpentine pump. In further embodiments, the acoustic micropump structure includes a deflectable membrane having valves in the deflectable membrane. In such embodiments, the valves may include one way valves. In other such embodiments, the valves may include voltage controlled valves.

In various embodiments, the acoustic micropump structure includes a rotor pump. In some embodiments, the microspeaker further includes a back volume coupled to the acoustic micropump structure and a front volume coupled to the acoustic micropump structure and having an output configured to output the acoustic signal. In such embodiments, the acoustic micropump structure is further configured to pump between the back volume and the front volume. In some embodiments, the front volume includes a filter membrane on the output. In further embodiments, the acoustic micropump structure includes a plurality of acoustic micropump structures disposed in a same substrate and configured as a micropump array.

According to an embodiment, a speaker includes an acoustic pump configured to generate a carrier signal having a first frequency by exciting the acoustic pump at the first frequency and generate an acoustic signal having a second frequency by adjusting the carrier signal. The first frequency is outside an audible frequency range and the second frequency is inside the audible frequency range. In such embodiments, adjusting the carrier signal includes performing adjustments to the carrier signal at the second frequency. Other embodiments include corresponding systems and apparatus, each configured to perform corresponding embodiment methods.

Implementations may include one or more of the following features. In various embodiments, generating the acoustic signal by adjusting the carrier signal includes adjusting a magnitude of the carrier signal according to the second frequency and adjusting a direction of pumping for the acoustic pump according to the second frequency. In some embodiments, the second frequency includes a plurality of frequencies inside the audible frequency range and the acoustic signal includes a plurality of sounds having the plurality of frequencies inside the audible frequency range.

In various embodiments, the first frequency is selected to match a resonant frequency of the acoustic pump. In some embodiments, the first frequency is held constant and the second frequency is varied. In further embodiments, the speaker further includes an integrated circuit coupled to the acoustic pump and configured to excite the acoustic pump at a plurality of frequencies, measure a plurality of responses of the acoustic pump corresponding to the plurality of frequencies, and determine a resonant frequency of the acoustic pump based on measuring the plurality of responses. The integrated circuit may be further configured to set the first frequency to the resonant frequency. In a still further embodiment, the integrated circuit is further configured to tune the resonant frequency of the acoustic pump by adjusting mechanical components within the acoustic pump.

An advantage of various embodiments may include, for example, microspeakers capable of producing audible sounds with SPLs that diminish little or none at lower frequencies, e.g., below 100 Hz. Another advantage of various embodiments may include increased efficiency of operation for microspeakers. Further advantages of various embodiments may include microspeakers with large deflections based on resonant mode excitation and microspeakers capable of producing audible sounds with high SPLs. Still another advantage of various embodiments may include a microspeaker with a flat frequency curve. A yet further advantage of some embodiments may include a microspeaker capable of producing frequencies above the audible range for use in ultrasound or near field detection, for example.

Description is made herein primarily in reference to acoustic signals in air. However, in further embodiments, embodiment methods and structures may be applied to signals produced any medium.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of operating a speaker comprising an acoustic pump, the method comprising:

generating a carrier signal having a first frequency by exciting the acoustic pump at the first frequency, wherein the first frequency is outside an audible frequency range; and generating an acoustic signal having a second frequency by adjusting the carrier signal, wherein adjusting the carrier signal comprises performing adjustments to the carrier signal at the second frequency and adjusting a direction of pumping for the acoustic pump according to the second frequency, adjusting the direction of pumping comprises changing a direction of flow of an elastic medium through the acoustic pump from a first direction to a second direction, and the second frequency is inside the audible frequency range.

2. The method of claim 1, wherein generating the acoustic signal by adjusting the carrier signal comprises adjusting a magnitude of the carrier signal according to the second frequency.

3. The method of claim 1, wherein the second frequency comprises a plurality of frequencies inside the audible frequency range; and the acoustic signal comprises a plurality of sounds having the plurality of frequencies inside the audible frequency range.

4. The method of claim 1, wherein exciting the acoustic pump comprises exciting a micropump structure.

5. The method of claim 1, wherein the first frequency is above 100 kHz and the second frequency is below 23 kHz.

6. The method of claim 1, wherein the first frequency is selected to match a resonant frequency of the acoustic pump.

7. The method of claim 1, wherein the first frequency is held constant and the second frequency is varied.

8. The method of claim 1, further comprising, before generating the carrier signal:

exciting the acoustic pump at a plurality of frequencies;

measuring a plurality of responses of the acoustic pump corresponding to the plurality of frequencies; and determining a resonant frequency of the acoustic pump based on measuring the plurality of responses.

9. The method of claim 8, further comprising, before generating the carrier signal, setting the first frequency to the resonant frequency.

10. The method of claim 8, further comprising, before generating the carrier signal, tuning the resonant frequency of the acoustic pump by adjusting mechanical components within the acoustic pump.

11. The method of claim 1, wherein the first frequency is above an upper audible frequency limit.

12. The method of claim 1, wherein the first direction comprises a first component perpendicular to a surface of the acoustic pump, and the second direction comprises a second component opposite the first component.

13. A speaker comprising:

an acoustic pump configured to generate a carrier signal having a first frequency by exciting the acoustic pump at the first frequency, wherein the first frequency is outside an audible frequency range; and generate an acoustic signal having a second frequency by adjusting the carrier signal, wherein adjusting the carrier signal comprises performing adjustments to the carrier signal at the second frequency and adjusting a direction of pumping for the acoustic pump according to the second frequency, adjusting the direction of pumping comprises changing a direction of flow of an elastic medium through the acoustic pump from a first direction to a second direction, and the second frequency is inside the audible frequency range.

14. The speaker of claim 13, wherein generating the acoustic signal by adjusting the carrier signal comprises adjusting a magnitude of the carrier signal according to the second frequency.

15. The speaker of claim 13, wherein the second frequency comprises a plurality of frequencies inside the audible frequency range; and the acoustic signal comprises a plurality of sounds having the plurality of frequencies inside the audible frequency range.

16. The speaker of claim 13, wherein the first frequency is selected to match a resonant frequency of the acoustic pump.

17. The speaker of claim 13, wherein the first frequency is held constant and the second frequency is varied.

18. The speaker of claim 13, further comprising an integrated circuit coupled to the acoustic pump and configured to:

excite the acoustic pump at a plurality of frequencies;

measure a plurality of responses of the acoustic pump corresponding to the plurality of frequencies; and determine a resonant frequency of the acoustic pump based on measuring the plurality of responses.

19. The speaker of claim 18, wherein the integrated circuit is further configured to set the first frequency to the resonant frequency.

20. The speaker of claim 18, wherein the integrated circuit is further configured to tune the resonant frequency of the acoustic pump by adjusting mechanical components within the acoustic pump.

21. The speaker of claim 13, wherein the acoustic pump comprises a deflectable membrane partitioned into a plurality of sections with slits separating the plurality of sections.

22. The speaker of claim 13, wherein the acoustic pump comprises a serpentine pump.

23. The speaker of claim 13, wherein the acoustic pump comprises a deflectable membrane, and wherein the deflectable membrane comprises valves.

24. The speaker of claim 23, wherein the valves comprise one way valves.

25. The speaker of claim 23, wherein the valves comprise voltage controlled valves.

26. The speaker of claim 13, wherein the acoustic pump comprises a rotor pump.

27. The speaker of claim 13, further comprising:

a back volume coupled to the acoustic pump;

a front volume coupled to the acoustic pump and having an output configured to output the acoustic signal; and wherein the acoustic pump is further configured to pump between the back volume and the front volume.

28. The speaker of claim 27, wherein the front volume comprises a filter membrane on the output.

29. The speaker of claim 13, wherein the acoustic pump comprises a plurality of acoustic pumps disposed in a same substrate and configured as an acoustic pump array.

30. The speaker of claim 13, wherein the first direction comprises a first component perpendicular to a surface of the acoustic pump, and the second direction comprises a second component opposite the first component.

* * * * *